US005079858A

United States Patent [19]

Sartor et al.

[11] Patent Number: 5,079,858

[45] Date of Patent: Jan. 14, 1992

[54] HEEL SECURING DEVICE PARTICULARLY FOR SKI BOOTS

[75] Inventors: Mariano Sartor, Montebelluna; Mirco Battistella, Breda Di Piave, both of Italy

[73] Assignee: Nordica S.p.A., Montebelluna, Italy

[21] Appl. No.: 725,891

[22] Filed: Jul. 1, 1991

Related U.S. Application Data

[63] Continuation of Ser. No. 450,497, Dec. 14, 1989, abandoned.

[30] Foreign Application Priority Data

Dec. 23, 1988 [IT] Italy ..... 82621 A/88

[51] Int. Cl.[5] ..... A43B 5/04

[52] U.S. Cl. ..... 36/117

[58] Field of Search ..... 36/117, 118, 119, 120, 36/121, 92

[56] References Cited

U.S. PATENT DOCUMENTS

| | | | |
|---|---|---|---|
| 3,239,952 | 3/1966 | Lange et al. | 36/119 |
| 3,798,800 | 3/1974 | Rathmell | 36/119 |
| 4,179,827 | 12/1979 | Vaccari | 36/119 |
| 4,360,979 | 11/1982 | Spademan | 36/121 |
| 4,719,709 | 1/1988 | Vaccari | 36/117 |
| 4,724,625 | 2/1988 | Sartor | 36/117 |
| 4,949,479 | 8/1990 | Ottieri | 36/117 |

FOREIGN PATENT DOCUMENTS

| | | | |
|---|---|---|---|
| 304017 | 12/1954 | Switzerland | 36/117 |

*Primary Examiner*—Daniel P. Stodola
*Assistant Examiner*—John P. Darling
*Attorney, Agent, or Firm*—Guido Modiano; Albert Josif

[57] ABSTRACT

A heel securing device, for ski boots of the rear-entry type comprising a front quarter and a rear quarter which are associated with a shell inside which an inner shoe can be removably arranged. The peculiarity of the device resides in that it is constituted by at least one flap which is associated with, or provided at, the shell, the inner shoe or an adapted removable heel element, the other free end embracing the rear region of the heel overlying the perimetric edge of the shell. It is thus possible, once the rear quarter is secured onto the front one, to achieve uniform pressure on the entire heel region without activating adapted and specific means.

9 Claims, 2 Drawing Sheets

HEEL SECURING DEVICE PARTICULARLY FOR SKI BOOTS

This is a continuation application of application Ser. No. 07/450,497 filed Dec. 14, 1989, now abandoned.

BACKGROUND OF THE INVENTION

The present invention relates to a heel securing device, particularly usable in ski boots of the rear-entry type.

Ski boots are currently known which use, in order to secure the heel, a flap which is rigidly associated with the shell and protrudes therefrom; said flap usually interacts with a traction element which embraces it, and therefore when the traction element is tensioned the flap moves onto the heel of the skier so as to block any movement thereof.

Devices are also known which are again constituted by a flap which protrudes rearward from the shell but interacts with an adapted plate provided with a threaded stem which is rotatably associated with the rear quarter and can be activated by means of an adapted knob operated by the skier.

All the above described kinds of device, however, have disadvantages: from the anatomical point of view, it can be seen that the flap exerts a pressure which is mainly localized at the achilles' tendon, and this causes pain which increases especially during flexing.

Furthermore, because of the flap, the foot is not easily inserted since the flap constitutes an obstacle for an easy insertion.

The skier therefore usually inserts his hand inside the boot to move the flap backward during insertion, and this causes discomfort.

As a partial solution to these disadvantages, the same Applicant filed U.S. Pat. No. 4,724,625, related to a ski boot, particularly of the rear-entry type, with foot securing device, disclosing an elongated element which extends transversely to the longitudinal extension of the rear quarter, said elongated element being provided inside the rear quarter and substantially at the heel of the user's foot and being connected to the opposite longitudinal edges of said rear quarter.

This solution, despite being undoubtedly valid, entailed a prior manual adjustment to be performed directly by the skier, and was in any case particularly expensive.

Devices are also known which are constituted by heel elements provided with lateral flaps adapted to embrace the malleolar regions of the skier; said devices, however, allow, for example, to center the foot or malleolar protection and therefore have a precise function as true protections and secondarily act as space fillers.

SUMMARY OF THE INVENTION

The aim of the present invention is therefore to eliminate the disadvantages described above in known types by providing a device which allows to achieve the optimum securing of the heel inside a ski boot by exerting a uniform pressure which, by lacking localized pressure regions, increases the skier's comfort.

Within the scope of the above described aim, another important object is to provide a device which allows the easy insertion of the foot in the boot.

Another important object is to provide a device which does not require preset and particular means for its activation which force the skier to perform a specific operation.

Not least object is to provide a device which is structurally simple, reliable and safe in use as well as extremely economical.

The above described aim and objects, as well as others which will become apparent hereinafter, are achieved by a heel securing device, particularly for ski boots comprising a front quarter and a rear quarter which are associated with a shell inside which an inner shoe is removably arrangeable, characterized in that it comprises at least one flap which, at one end, is associated with a boot member, the other free end embracing the rear region of the heel which overlies the perimetric edge of said shell.

Said device can advantageously comprise at least one pair of flaps which, at one end, are associated with, or provided in, said shell or said inner shoe or an adapted removable heel element, the other free ends being partially mutually superimposed to embrace the rear region of the heel overlying the perimetric edge of said shell.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
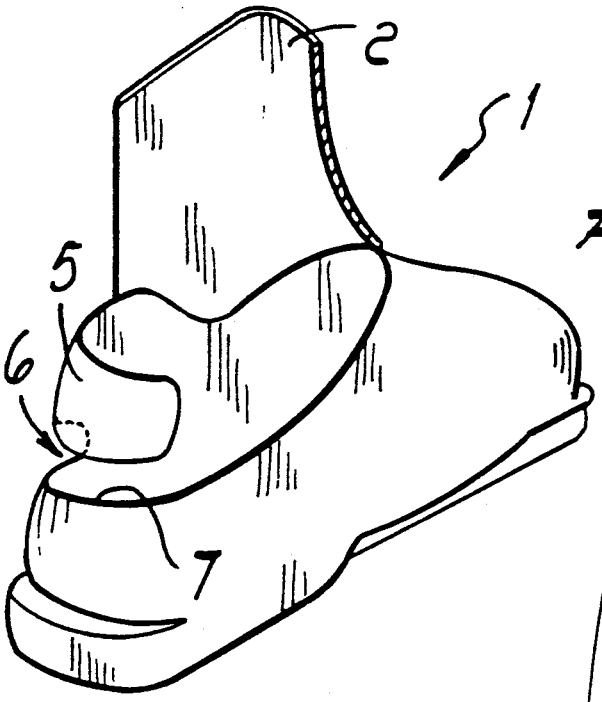
FIG. 1 is a partially sectional perspective view of a shell provided with a device according to the invention.

With reference to the above figures, the reference numeral 1 indicates a ski boot constituted by a front quarter 2 and by a rear quarter 3 which are associated with a shell 4.

The device comprises at least one flap 5 which, in the particular embodiment illustrated in FIG. 1, is obtained directly at the shell and protrudes laterally from said shell, i.e. the flap 5 protrudes from a lateral side portion of the shell 4. As can be seen in the FIG. 1, the flap has a transversely extending portion adapted to transversely affect and embrace the rear region 6 of the heel overlying the perimetric edge 7 of the shell 4.

Said at least one flap is advantageously associated with, or provided at, an adapted inner shoe which can be arranged inside the boot or at an adapted heel element which can be removably arranged thereat.

Figure 2:
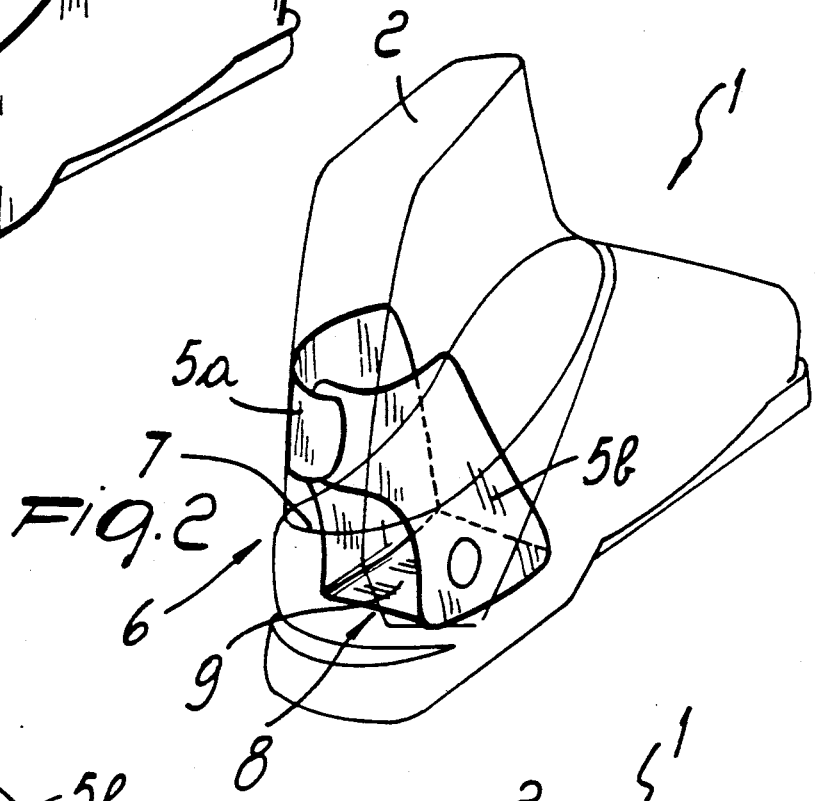
FIG. 2 is a view, similar to the preceding one, of a further embodiment of the device.
Figure 3:
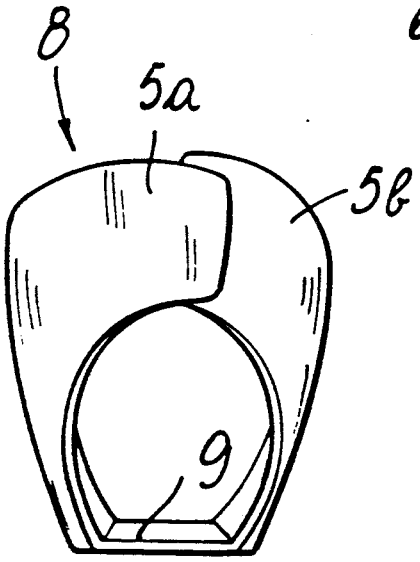
FIG. 3 is a rear view of the device illustrated in FIG. 2.
Figure 4:
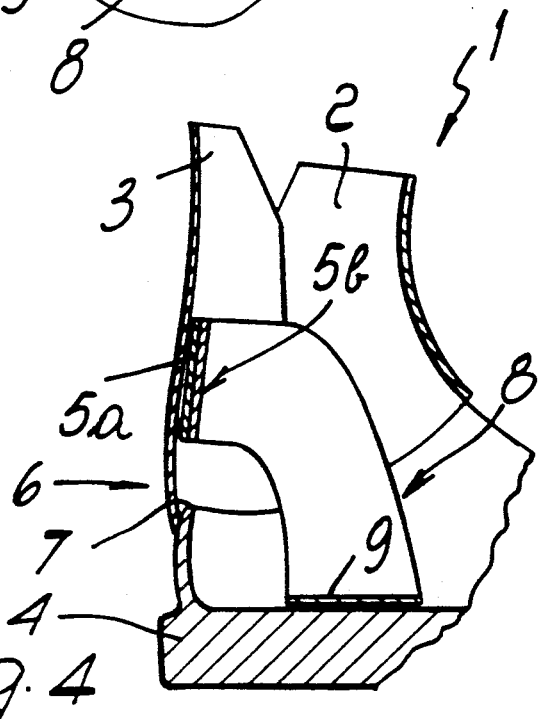
FIG. 4 is a view, taken along a longitudinal middle sectional plane of the boot, of the device illustrated in FIGS. 2 and 3.

In this last condition, the heel element, generally indicated by the reference numeral 8, has a planar support base 9 from which a pair of flaps 5*a* and 5*b* protrude; in particular, it can be seen from the figures that each flap 5*a* and 5*b* of the heel element 8 has an upwardly extending portion which, when the heel element is arranged in the ski boot, upwardly extends from the lateral side portion of the shell 4. Furthermore, each flap has a free end which defines a transversely extending portion integral with the upwardly extending portion. As can be seen particularly from FIGS. 2 and 3, said flaps transversely embrace, at their free end which defines the transversely extending portion, the rear region 6 of the heel which overlies the perimetric edge 7 of the shell 4.

Said flaps 5*a* and 5*b* partially overlap one another at said region and are elastically deformable.

The device in fact is operated when the rear quarter 3 is moved toward the front quarter 2 (for example during the closure thereof); during this step, the rear quarter in fact rests at the flap or flaps 5*a* and 5*b*, increasing their mutual overlap and therefore tightening them due to the pressure exerted thereon.

Said pressure is furthermore exerted evenly on the entire heel region, since the two flaps embrace it uniformly.

It has thus been observed that the invention achieves the intended aim and objects, a heel securing device having been provided which has considerable comfort for the skier by virtue of the elimination of pressure points due to the uniform embracing action of the flap or flaps at the heel region.

Said device furthermore allows to easily insert the foot in the boot, since the flap or flaps are open when the skier places the front and rear quarters in open position.

The device is furthermore structurally very simple and extremely economical.

Figure 5:
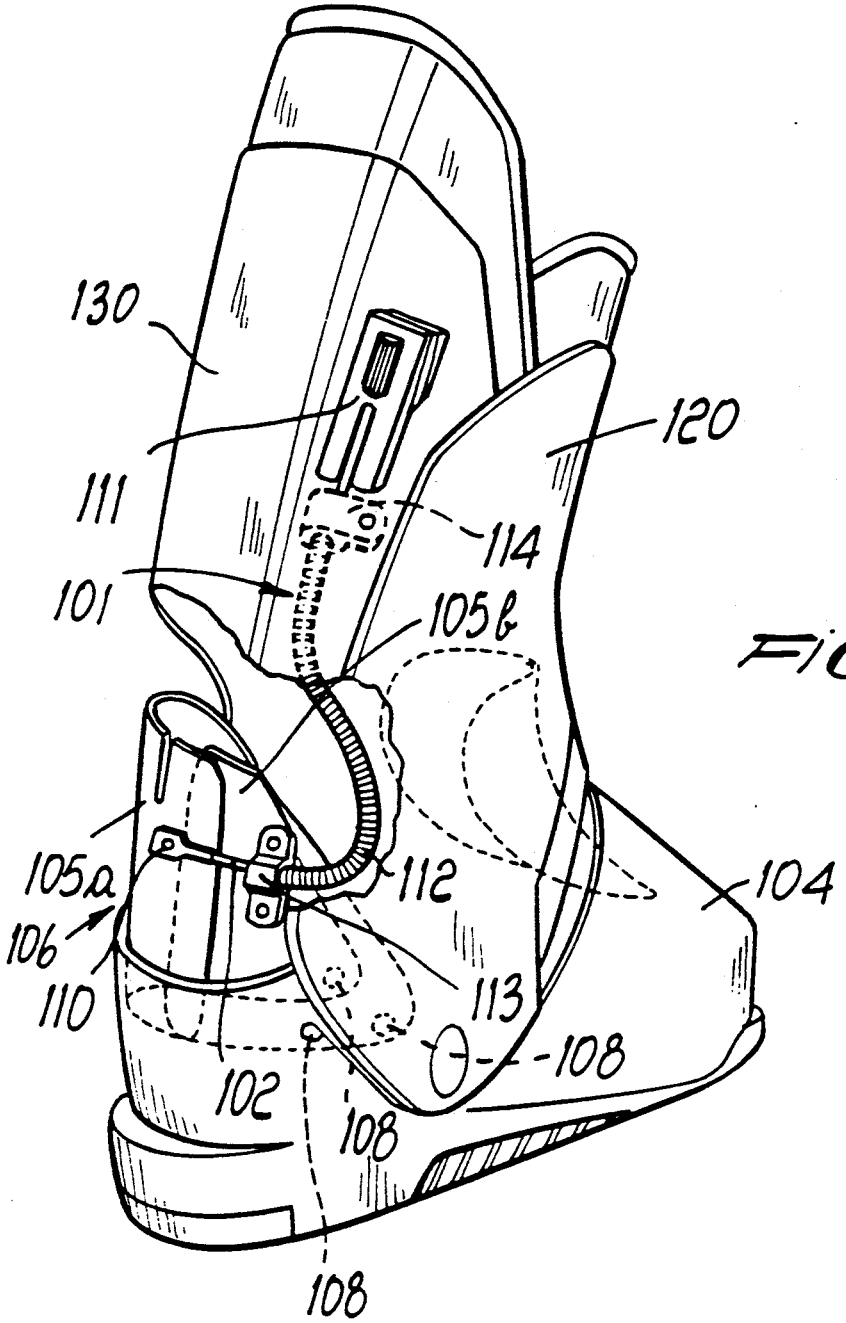
FIG. 5 is a partially sectioned rear isometric view of a ski boot according to still a further aspect of the invention.
Figure 6:
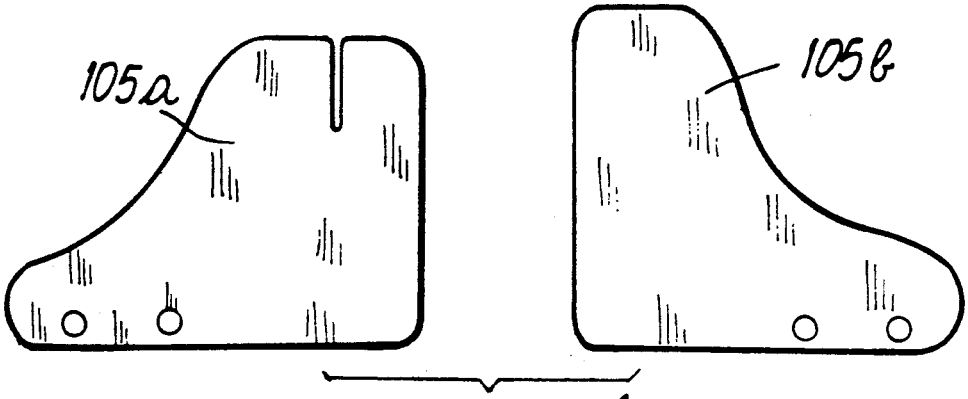
FIG. 6 is a side view of the two flaps provided in the ski boot shown in FIG. 5.

FIGS. 5 and 6 show a ski boot, according to another aspect of the invention, having a pair of flaps 105*a* and 105*b*, partially overlapping at the heel region 106 of the boot.

The flaps 105*a* and 105*b* are associated with the shell 104 at bolts 108 but naturally they may also be provided in one piece with the shell itself.

The flaps 105*a*, 105*b* are provided with an overlap control means 101 comprising a traction element 102, a wire for example, having a first end 110 fixed to one flap, 105*a* for example, and the second end connected to a tensioning device 111 of a per se known type.

The wire 102 is slideably engaged in a sheath 112 having a fixed end 113 associated with the second flap 105*b*.

In the illustrated example, the second end 114 of the sheath is fixed to the rear quarter 130 together with the tensioning device 111: in this manner the overlapping of the flaps can be adjusted independently from the position of the rear quarter.

Naturally, the tensioning device 111 can be associated also with either the front quarter 120 or with the shell 104, according to the specific needs.

The invention thus conceived is naturally susceptible to numerous modifications and variations, all of which are within the scope of the same inventive concept.

The materials as well as the dimensions which constitute the individual components of the device may naturally also be the most pertinent according to the specific requirements.

We claim:

1. In a ski boot construction having a shell portion and a rear quarter hingedly connected to said shell portion, said rear quarter having a concave configuration facing inwards and defining a heel region inside said ski boot construction for accommodating a wearer's heel, said shell portion defining a first lateral side shell portion and a second lateral side shell portion, a heel securing device comprising a first flap element and a second flap element both arranged inside said ski boot construction, said first flap element defining a first flap element first end and a first flap element second end, said first flap element first end being at least temporarily constrainedly secured to said first lateral side shell portion, said second flap element defining a second flap element first end and a second flap element second end, said second flap element first end being at least temporarily constrainedly secured to said second lateral side shell portion, said first flap element second end and said second flap element second end at least partially mutually overlapping at said heel region and further both said first flap element second end and said second flap element second end having a concave configuration facing inwards of said ski boot construction so as to envelope said heel region, said first flap element second end and said second flap element second end defining a mutual relative overlapping which is adjustable in a direction perpendicular to the vertical extension of a wearer's achilles tendon.

2. Heel securing device according to claim 1, wherein said mutual relative overlapping of said first flap element second end and said second flap element second end is adjustable by means of said rear quarter whereby a closure of said rear quarter exerts a pressure on said mutually overlapping first and second flap element second ends.

3. Heel securing device according to claim 1, wherein said mutual overlapping of said first flap element second end and said second flap element second end is adjustable by means of control means comprising a wire having a fixed end connected with one of said flap elements and a second end connected to a tensioning device, said wire being slidably engaged in a sheath, said sheath being connected with a second of said flap elements, said sheath being furthermore connected together with said tensioning element to a ski boot element separated from said one of said flap elements.

4. Heel securing device according to claim 1, wherein said first flap element and said second flap element are elastically deformable.

5. Heel securing device according to claim 1, wherein said first flap element first end is integrally formed with said first lateral side shell portion and said second flap element first end is integrally formed with said second lateral side shell portion.

6. In a ski boot construction having a shell portion and a rear quarter hingedly connected to said shell portion, said rear quarter having a concave configuration facing inwards and defining a heel region inside said ski boot construction for accommodating a wearer's heel, said shell portion defining a first lateral side shell portion and a second lateral side shell portion, a heel securing device comprising a first flap element and a second flap element both arranged inside said ski boot construction, said first flap element defining a first flap element first end and a first flap element second end, said first flap element first end being at least temporarily constrainedly secured to said first lateral side shell portion, said second flap element defining a second flap element first end and a second flap element second end, said second flap element first end being at least temporarily constrainedly secured to said second lateral side shell portion, said first flap element second end and said second flap element second end at least partially mutually overlapping at said heel region and further both said first flap element second end and said second flap element second end having a concave configuration facing inwards of said ski boot construction so as to envelope said heel region, said first flap element second end and said second flap element second end defining a mutual relative overlapping which is adjustable in a direction perpendicular to the vertical extension of a wearer's achilles tendon, said heel securing device further comprising a heel element, said heel element having a base defining a first base end and a second base end, said heel element being arranged in said ski boot construction such that said first base end is arranged at said first lateral side shell portion and said second base end is arranged at said second lateral side shell portion, said first flap element first end being integral with said first base end and said second flap element first end being integral with said second base end.

7. Heel securing device according to claim 6, wherein said heel element is removably arranged in said ski boot construction, said ski boot construction further comprising an inner shoe, said base of said heel element being arranged between said inner shoe and said shell portion and said mutually overlapping first and second flap element second ends being arranged between said rear quarter and said inner shoe, said mutual relative overlapping of said first flap element second end and said second flap element second end being adjustable by means of said rear quarter whereby a closure of said rear quarter exerts a pressure on said mutually overlapping first and second flap element second ends.

8. In a ski boot construction having a shell portion and a rear quarter hingedly connected to said shell portion, said rear quarter having a concave configuration facing inwards and defining a heel region inside said ski boot construction for accommodating a wearer's heel, said shell portion defining a first lateral side shell portion and a second lateral side shell portion, a heel securing device comprising a first flap element and a second flap element both arranged inside said ski boot construction, said first flap element defining a first flap element first end and a first flap element second end, said first flap element first end being at least temporarily constrainedly secured to said first lateral side shell portion, said second flap element defining a second flap element first end and a second flap element second end, said second flap element first end being at least temporarily constrainedly secured to said second lateral side shell portion, said first flap element second end and said second flap element second end at least partially mutually overlapping at said heel region and further both said first flap element second end and said second flap element second end having a concave configuration facing inwards of said ski boot construction so as to envelope said heel region, said first flap element second end and said second flap element second end defining a mutual relative overlapping which is adjustable in a direction perpendicular to the vertical extension of a wearer's achilles tendon, said first flap element first end being bolted to said first lateral side shell portion and said second flap element first end being bolted to said second lateral side shell portion.

9. Heel securing device according to claim 8, wherein said mutual overlapping of said first flap element second end and said second flap element second end is adjustable by means of control means comprising a wire having a fixed end connected with one of said flap elements and a second end connected to a tensioning device, said wire being slidably engaged in a sheath, said sheath being connected with a second of said flap elements, said sheath being furthermore connected together with said tensioning element to a ski boot element separated from said one of said flap elements.

* * * * *